US012662349B2

(12) United States Patent
Wang et al.

(10) Patent No.: US 12,662,349 B2
(45) Date of Patent: Jun. 23, 2026

(54) METHOD AND APPARATUS OF PROCESSING YARN SPINDLE, DEVICE AND STORAGE MEDIUM

(71) Applicants: ZHEJIANG HENGYI PETROCHEMICAL CO., LTD., Zhejiang (CN); HAINING HENGQI ENVIRONMENTAL PROTECTION TECHNOLOGY CO., LTD., Jiaxing City (CN); JIAXING YIPENG CHEMICAL FIBER CO., LTD., Jiaxing City (CN)

(72) Inventors: Peng Wang, Zhejiang (CN); Jiangang Chen, Zhejiang (CN); Xiantao Peng, Zhejiang (CN); Yibo Qiu, Zhejiang (CN); Dake Li, Zhejiang (CN); Feng Xu, Zhejiang (CN); Junliang Jin, Zhejiang (CN); Yaobin Zhang, Zhejiang (CN)

(73) Assignees: ZHEJIANG HENGYI PETROCHEMICAL CO., LTD., Zhejiang (CN); HAINING HENGQI ENVIRONMENTAL PROTECTION TECHNOLOGY CO., LTD., Jiaxing City (CN); JIAXING YIPENG CHEMICAL FIBER CO., LTD., Jiaxing City (CN)

( * ) Notice: Subject to any disclaimer, the term of this patent is extended or adjusted under 35 U.S.C. 154(b) by 0 days.

(21) Appl. No.: 19/039,044

(22) Filed: Jan. 28, 2025

(65) Prior Publication Data

US 2025/0304405 A1 Oct. 2, 2025

(30) Foreign Application Priority Data

Mar. 27, 2024 (CN) ..... 202410386278.0

(51) Int. Cl.
*B65H 67/06* (2006.01)
*D01D 10/02* (2006.01)

(52) U.S. Cl.
CPC ..... *B65H 67/06* (2013.01); *D01D 10/02* (2013.01); *B65H 67/062* (2013.01);
(Continued)

(58) Field of Classification Search
CPC .... B65H 67/06; B65H 67/062; B65H 67/064; B65H 2701/31; D01D 10/02
(Continued)

(56) References Cited

U.S. PATENT DOCUMENTS 2,696,901 A * 12/1954 Peterson ..... B65H 67/06 198/478.1
3,906,712 A * 9/1975 Miyazaki ..... B65H 67/064 57/281
(Continued)

FOREIGN PATENT DOCUMENTS

CN 112678617 A 4/2021
JP 1974126916 A 12/1974
(Continued)

OTHER PUBLICATIONS

English Translation of JPS59100743 (Year: 1982).*
(Continued)

*Primary Examiner* — Alissa J Tompkins
*Assistant Examiner* — Dakota Marin
(74) *Attorney, Agent, or Firm* — Perilla Knox Hildebrandt Staley & Amy LLP

(57) ABSTRACT

Provided is a method of processing a yarn spindle, an electronic device and a storage medium. The method includes: after determining a target yarn box to be transferred to a temporary storage facility, selecting N candidate storage locations from a plurality of storage locations in the
(Continued)

temporary storage facility, where the target yarn box contains a plurality of yarn spindles to be cooled, and N is a positive integer greater than or equal to 1; obtaining an actual temperature of each of the N candidate storage locations; and selecting a target storage location from the N candidate storage locations based on the actual temperature of each candidate storage location, and temporarily storing the target yarn box to the target storage location.

6 Claims, 5 Drawing Sheets

(52) U.S. Cl.
CPC ..... *B65H 67/063* (2013.01); *B65H 67/064* (2013.01); *B65H 2701/31* (2013.01)

(58) Field of Classification Search
USPC ..... 57/281
See application file for complete search history.

(56) References Cited

U.S. PATENT DOCUMENTS 3,924,762 A * 12/1975 Igel ..... D01H 9/18 414/331.11
3,981,551 A * 9/1976 Miyazaki ..... B65H 67/064 312/249.8
4,605,177 A * 8/1986 Uchida ..... B65H 67/06 242/474.1
4,660,369 A * 4/1987 Konishi ..... B65H 67/06 198/346.2
5,495,990 A * 3/1996 Tamura ..... B65H 54/34 242/475.7
5,900,553 A * 5/1999 Hasegawa ..... B65H 63/00 73/660
11,977,371 B2 * 5/2024 Blaser ..... B65H 67/063
12,214,987 B2 * 2/2025 Shamis ..... B65H 49/16
2001/0037545 A1 * 11/2001 Stuttem ..... B65H 63/086 28/248
2020/0189860 A1 * 6/2020 Brakensiek ..... B65H 54/26
2021/0016336 A1 * 1/2021 Hedvall ..... B65H 49/38
2024/0417892 A1 * 12/2024 Moore ..... B25J 9/1687
2025/0115456 A1 * 4/2025 Li ..... B65H 49/38

FOREIGN PATENT DOCUMENTS

JP 1974126917 A 12/1974
JP S59100743 A * 6/1984
JP 2025009707 A 1/2025

OTHER PUBLICATIONS

European Search Report dated Jun. 2, 2025 in European Patent Application No. 25154256.9.
Notice of Reasons for Rejection dated Mar. 11, 2025 in Japanese Patent Application No. 2025-022163.
Notice of Allowance dated Apr. 7, 2025 in Japanese Patent Application No. 2025-022163.

* cited by examiner

METHOD AND APPARATUS OF PROCESSING YARN SPINDLE, DEVICE AND STORAGE MEDIUM

CROSS-REFERENCE TO RELATED APPLICATIONS

The present application claims priorities to Chinese Patent Application No. CN202410386278.0, filed with the China National Intellectual Property Administration on Mar. 27, 2024, the disclosures of which is hereby incorporated herein by reference in its entirety.

TECHNICAL FIELD

The present disclosure relates to the field of data processing technologies, and in particular, to a method and an apparatus of processing a yarn spindle, a device, and a storage medium.

BACKGROUND

The cooling treatment is an important link in the process of producing yarn spindles. Batches of yarn spindles are transported to a designated cooling area (such as a workshop floor) for natural cooling. However, the cooling method lacks a reasonable planning of the spatial distribution for cooling, and can easily affect the quality of the yarn spindles, thereby lowering the cooling efficiency.

SUMMARY

The present disclosure provides a method and an apparatus of processing a yarn spindle, a device and a storage medium to solve or mitigate one or more technical problems in the related art.

In a first aspect, the present disclosure provides a method of processing a yarn spindle, including:

after determining a target yarn box to be transferred to a temporary storage facility, selecting N candidate storage locations from a plurality of storage locations in the temporary storage facility, where the target yarn box contains a plurality of yarn spindles to be cooled, and N is a positive integer greater than or equal to 1;

obtaining an actual temperature of each of the N candidate storage locations; and selecting a target storage location from the N candidate storage locations based on the actual temperature of each candidate storage location, and temporarily storing the target yarn box to the target storage location.

In a second aspect, the present disclosure provides an apparatus of processing a yarn spindle, including:

a first processing unit, configured to, after determining a target yarn box to be transferred to a temporary storage facility, select N candidate storage locations from a plurality of storage locations in the temporary storage facility, where the target yarn box contains a plurality of yarn spindles to be cooled, and N is a positive integer greater than or equal to 1;

a temperature obtaining unit, configured to obtain an actual temperature of each of the N candidate storage locations; and a second processing unit, configured to select a target storage location from the N candidate storage locations based on the actual temperature of each candidate storage location, and temporarily store the target yarn box to the target storage location.

According to a third aspect, provided is an electronic device, including:

at least one processor; and a memory connected in communication with the at least one processor, where the memory stores an instruction executable by the at least one processor, and the instruction, when executed by the at least one processor, enables the at least one processor to execute the method of any embodiment of the present disclosure.

According to a fourth aspect, provided is a non-transitory computer-readable storage medium storing a computer instruction thereon, where the computer instruction is used to cause a computer to execute the method of any embodiment of the present disclosure.

According to a fifth aspect, provided is a computer program product, including a computer program, where the computer program, when executed by a processor, executes the method of any embodiment of the present disclosure.

As such, the scheme of the present disclosure enables an automatic and intelligent selection of a suitable storage location (i.e., the target storage location) from the N candidate storage locations, based on the actual temperature of each of the N candidate storage locations, and then temporarily store the target yarn box to the selected target storage location for cooling treatment. The approach allows for effective cooling of the target yarn box, and compared to the natural cooling used in related art, can ensure that the quality of the yarn spindles is not affected while the cooling efficiency of the yarn spindles is improved.

It should be understood that the content described in this part is not intended to identify critical or essential features of embodiments of the present disclosure, nor is it used to limit the scope of the present disclosure. Other features of the present disclosure will be easily understood through the following description.

BRIEF DESCRIPTION OF THE DRAWINGS

In the drawings, like reference characters designate like or similar parts or elements throughout the accompanying figures unless otherwise specified. The figures are not necessarily drawn to scale. It should be understood that these figures depict only some of the embodiments in accordance with the present disclosure and are not to be considered as a limitation of the scope thereof.

DETAILED DESCRIPTION

Figure 1:
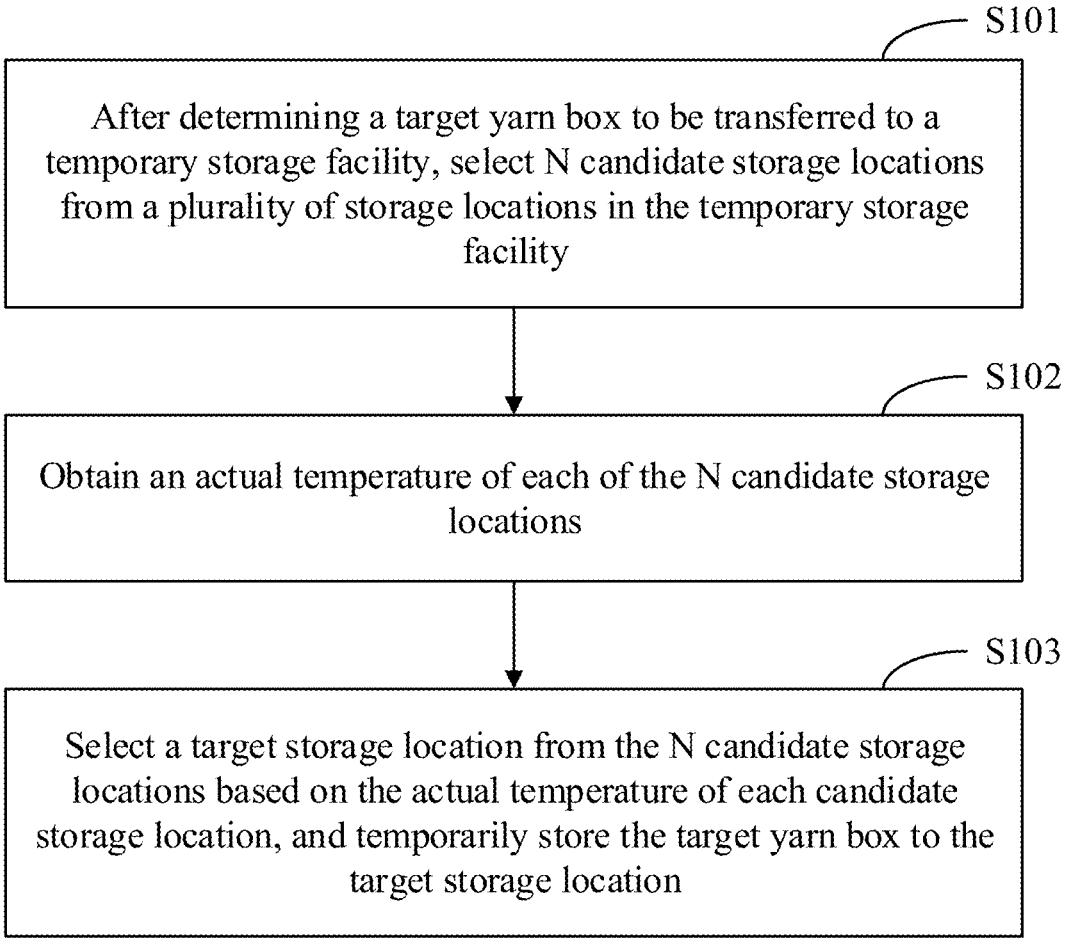
FIG. 1 is a schematic flowchart illustrating a method of processing a yarn spindle according to an embodiment of the present disclosure.

The present disclosure will be further described in detail below with reference to the accompanying figures. In the figures, like reference numerals indicate functionally identical or similar elements. While various aspects of the embodiments are presented in the figures, the figures are not necessarily drawn to scale unless specifically indicated.

In addition, in order to better explain the present disclosure, numerous specific details will be given in the following specific implementations. Those having ordinary skill in the art should be understood that the present disclosure may be performed without certain specific details. In some examples, methods, means, elements and circuits well known to those having ordinary skill in the art are not described in detail, in order to highlight the subject matter of the present disclosure.

The scheme of the present disclosure provides a method of processing a yarn spindle, which can automatically provide a reasonable planning for cooling the yarn spindle so as to improve the cooling efficiency of the yarn spindle.

Specifically, FIG. 1 is a schematic flowchart illustrating a method of processing a yarn spindle according to an embodiment of the present disclosure. The method is optionally applicable to an electronic device, such as a personal computer, a server, and/or a server cluster.

Further, the method includes at least some of the following contents, as shown in FIG. 1, including the following steps.

Step S101: after determining a target yarn box to be transferred to a temporary storage facility, N candidate storage locations are selected from a plurality of storage locations in the temporary storage facility.

Here, the target yarn box contains a plurality of yarn spindles to be cooled; and N is a positive integer greater than or equal to 1.

It should be noted that, the scheme of the present disclosure does not impose specific restrictions on the target yarn box to be transferred to the temporary storage facility. For example, a carry to be transferred to the temporary storage facility may be a trolley. Any carrier capable of placing a plurality of yarn spindles to be cooled is applicable to the scheme of the present disclosure.

Step S102: an actual temperature of each of the N candidate storage locations is obtained.

Step S103: a target storage location is selected from the N candidate storage locations based on the actual temperature of each candidate storage location, and the target yarn box is temporarily stored to the target storage location.

As such, the scheme of the present disclosure enables an automatic and intelligent selection of a suitable storage location (i.e., the target storage location) from the N candidate storage locations, based on the actual temperature of each of the N candidate storage locations, and then temporarily store the target yarn box to the selected target storage location for cooling treatment. The approach allows for effective cooling of the target yarn box, and compared to the natural cooling method used in related art, can ensure that the quality of the yarn spindles is not affected while the cooling efficiency of the yarn spindles is improved.

Furthermore, the scheme of the present disclosure can provide the storage location suitable for temporary storage of the target yarn box, so that the scheme of the present disclosure is more reasonable in use of the storage locations in the temporary storage facility, thereby improving the utilization rate of the storage locations in the temporary storage facility, providing more automatic and intelligent cooling treatment on the yarn spindles, and improving the management efficiency of the cooling link.

Further, in a specific example, the N candidate storage locations may be obtained in the following manner. In particular, after determining the target yarn box to be transferred to the temporary storage facility, selecting the N candidate storage locations from the plurality of storage locations in the temporary storage facility (for example, the Step S101 as described above) specifically includes:

Step S101-1: after determining the target yarn box to be transferred to the temporary storage facility, determining M storage locations in an idle state from the plurality of storage locations in the temporary storage facility; and Step S101-2: in a case where the quantity M of the storage locations is greater than a first threshold value, selecting the N candidate storage locations from the M storage locations in the idle state, where M is a positive integer greater than or equal to N; or in a case where the quantity M of the storage locations is less than or equal to the first threshold value, designating the M storage locations in the idle state as the N candidate storage locations.

In other words, in an example, after determining the target yarn box to be transferred to the temporary storage facility, firstly, the M storage locations in the idle state are determined from the plurality of storage locations in the temporary storage facility; secondly, whether the quantity M of the storage locations in the idle state is greater than the first threshold (for example, the first threshold is 1) is judged; if yes, a screening process is carried out to select the N candidate storage locations from the M storage locations; otherwise, the M storage locations are directly designated as the N candidate storage locations without the screening process.

As such, the scheme of the present disclosure can select the N candidate storage locations from the M storage locations that are in an idle state, which are suitable for cooling the target yarn box. The process lays a foundation for subsequently determining the target storage location appropriate for the cooling treatment of the target yarn box.

Figure 2:
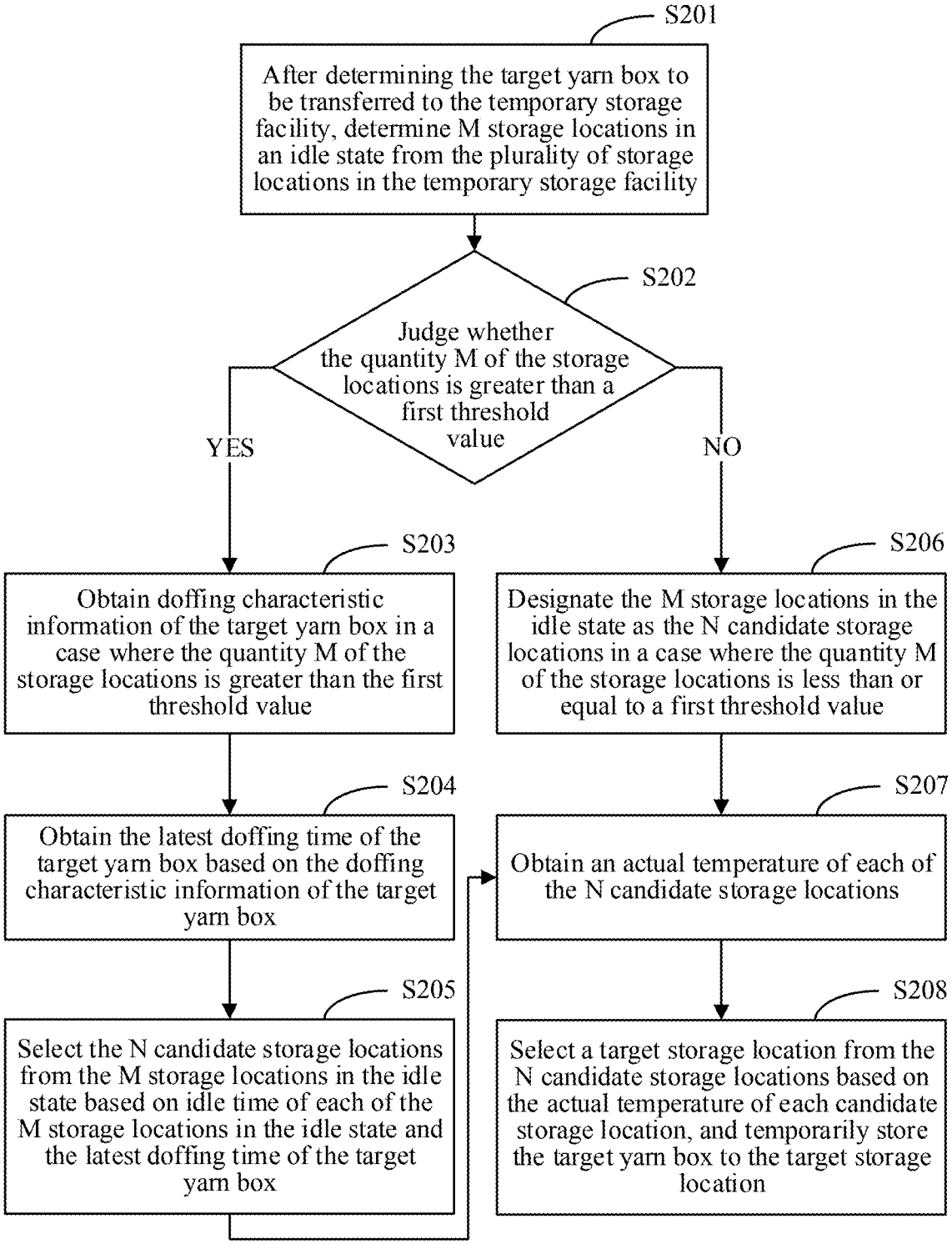
FIG. 2 is another schematic flowchart illustrating a method of processing a yarn spindle according to an embodiment of the present disclosure.

FIG. 2 is another schematic flowchart illustrating a method of processing a yarn spindle according to an embodiment of the present disclosure. The method is optionally applied to an electronic device, such as a personal computer, a server, and/or a server cluster. It can be understood that the contents related to the method shown in FIG. 1 above can also be applied to the example and will not be described in detail herein.

Further, the method includes at least some of the following contents, as shown in FIG. 2, including the following steps.

Step S201: after determining the target yarn box to be transferred to the temporary storage facility, M storage locations in an idle state are determined from the plurality of storage locations in the temporary storage facility.

Step S202: whether the quantity M of the storage locations is greater than a first threshold value is judged, if yes, proceed to Step S203, otherwise, proceed to Step S206.

Step S203: in a case where the quantity M of the storage locations is greater than the first threshold value, doffing characteristic information of the target yarn box is obtained, and proceed to Step S204.

Here, the doffing characteristic information of the target yarn box is obtained based on at least doffing time of the yarn spindles in the target box.

Figure 3:
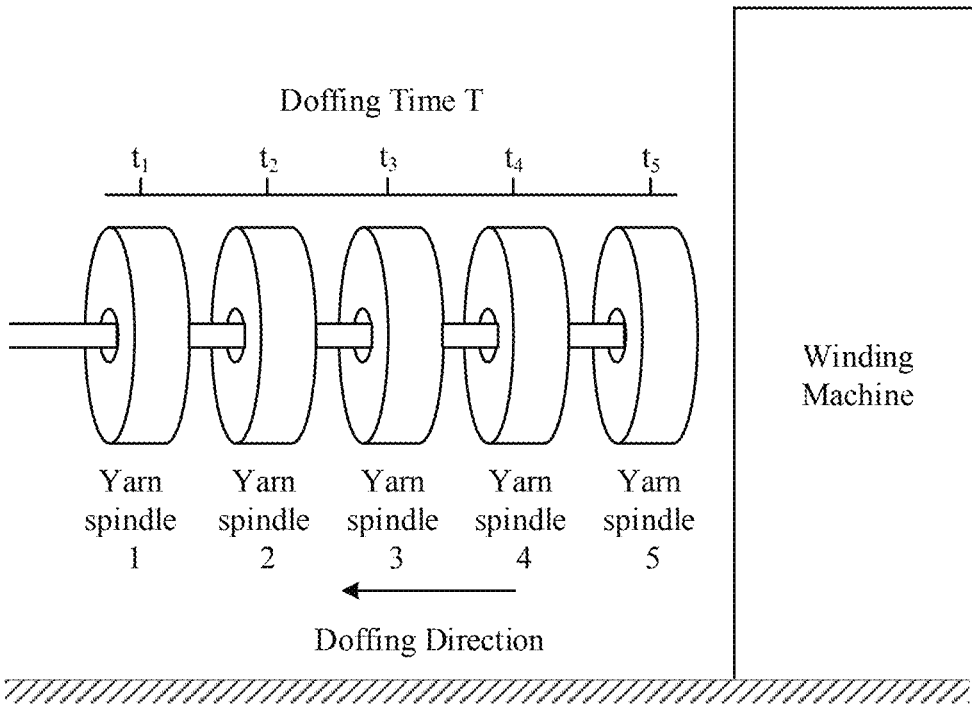
FIG. 3 is a schematic diagram illustrating a scenario of yarn spindle doffing according to an embodiment of the present disclosure.

It should be noted that, the doffing time of the yarn spindles in the target yarn box (or target trolley) specifically refers to the moment when the last yarn spindle, among the plurality of spindles to be cooled, is doffed into the target yarn box (or target trolley) from a winding machine. For example, as shown in FIG. 3, the winding machine sequentially doffs 5 yarn spindles, during which, for example, if the winding machine finishes doffing the yarn spindle 1 at time $t_1$, the doffing time of the yarn spindle 1 is $t_1$, if the winding machine finishes doffing the yarn spindle 2 at time $t_2$, the doffing time of the yarn spindle 2 is $t_2$, . . . , and if the winding machine finishes doffing the last yarn spindle (i.e., the yarn spindle 5) at time $t_5$, the doffing time of the yarn spindle 5 is $t_5$, and at this time, the latest doffing time of the yarn spindles placed within the target box is $t_5$.

Step S204: the latest doffing time of the target yarn box is obtained based on the doffing characteristic information of the target yarn box, and proceed to Step S205.

Step S205: the N candidate storage locations are selected from the M storage locations in the idle state based on idle time of each of the M storage locations in the idle state and the latest doffing time of the target yarn box, and proceed to Step S207.

Here, M is a positive integer greater than or equal to N.

Further, in a specific example, the N candidate storage locations may be selected in the following manner. In particular, selecting the N candidate storage locations from the M storage locations in the idle state based on the idle time of respective storage locations of the M storage locations in the idle state and the latest doffing time of the target yarn box (for example, the above Step S205) specifically includes the following steps.

Step S205-1: environmental characteristic information is obtained.

Herein, the environmental characteristic information may specifically be a seasonal characteristic, such as summer; or may specifically be a climate characteristic. The scheme of the present disclosure is not limited thereto.

Step S205-2: a time difference between the idle time of each of the M storage locations in the idle state and the latest doffing time of the target yarn box is determined.

Here, the execution sequence of Step S205-1 and Step S205-2 may also be such that Step S205-2 is executed first, followed by Step S205-1. The present disclosure does not impose any limitations on the execution sequence of Step S205-1 and Step S205-2.

Step S205-3: the N candidate storage locations capable of performing cooling processing on the yarn spindles in the target yarn box under an environment represented by the environmental characteristic information are selected based on the environmental characteristic information and the time difference corresponding to each of the M storage locations.

In a specific example, the scheme of the present disclosure can determine a preset time difference condition corresponding to the environmental characteristic information according to the environmental characteristic information, so as to select a storage location with the time difference satisfying the preset time difference condition corresponding to the environmental characteristic information (for example, a storage location with a larger time difference) from the M storage locations as a candidate storage location, thereby obtaining the N candidate storage locations. Therefore, the selection method for storage locations can be adaptively adjusted based on the environmental characteristic information. This ensures efficient cooling while avoiding excessively rapid cooling, thereby further ensuring the quality of the yarn spindles in the target yarn box.

For example, firstly, the environmental characteristic information is obtained. If the seasonal characteristic obtained is summer, it is determined that the preset time difference condition for summer requires a time difference greater than a preset time difference threshold −1. Secondly, the time difference between the idle time of each of the M storage locations in the idle state and the latest doffing time of the target yarn box is determined. Finally, the storage location where the time difference with respect to the latest doffing time of the target yarn box is greater than the preset time difference threshold −1 is selected from the M storage locations as the candidate storage location, thereby obtaining N candidate storage locations. Thus, selecting the storage locations with a larger time difference is beneficial to effective cooling of the target yarn box in a summer environment.

Alternatively, for another example, if the seasonal characteristic obtained is winter, it is determined that the preset time difference condition for winter requires a time difference less than a preset time difference threshold value −2. Secondly, the time difference between the idle time of each of the M storage locations in the idle state and the latest doffing time of the target yarn box is determined. Finally, the storage location where the time difference with respect to the latest doffing time of the target yarn box is greater than the preset time difference threshold −2 and less than the preset time difference threshold value −1 is selected from the M storage locations as the candidate storage location, thereby obtaining N candidate storage locations. Thus, selecting the storage locations with a smaller time difference helps avoid rapid cooling, thereby preventing any adverse effects on the quality of the yarn spindles.

Here, the preset time difference threshold −1 in the above example is greater than the preset time difference threshold −2, or the preset time difference threshold −1 may also be equal to the preset time difference threshold −2, which is not specifically limited in the present disclosure.

As such, the scheme of the present disclosure can select storage locations suitable for cooling the target yarn box under the environment represented by the environmental characteristic information from the M storage locations in the idle state in accordance with the environmental characteristic information. This ensures the quality of the yarn spindles in the target yarn box during the cooling process and provides more automatic cooling treatment on the yarn spindles, thereby enhancing the cooling efficiency of the yarn spindles.

Step S206: the M storage locations in the idle state are designated as the N candidate storage locations in a case where the quantity M of the storage locations is less than or equal to a first threshold value, and proceed to Step S207.

Step S207: an actual temperature of each of the N candidate storage locations is obtained.

Step S208: a target storage location is selected from the N candidate storage locations based on the actual temperature of each candidate storage location, and the target yarn box is temporarily stored to the target storage location.

As such, the scheme of the present disclosure can select the N candidate storage locations from the M storage locations in the idle state based on the doff characteristic information of the target yarn box, and then select the target storage location from the N candidate storage locations based on the actual temperature of each candidate storage location. This enables the rapid selection of suitable storage locations for temporarily storing the target yarn box, facilitating more effective cooling treatment while providing more rational and automatic selection of the storage locations within the temporary storage facility, thereby enhancing the quality and the overall cooling efficiency of the yarn spindles during the cooling treatment.

Figure 4:
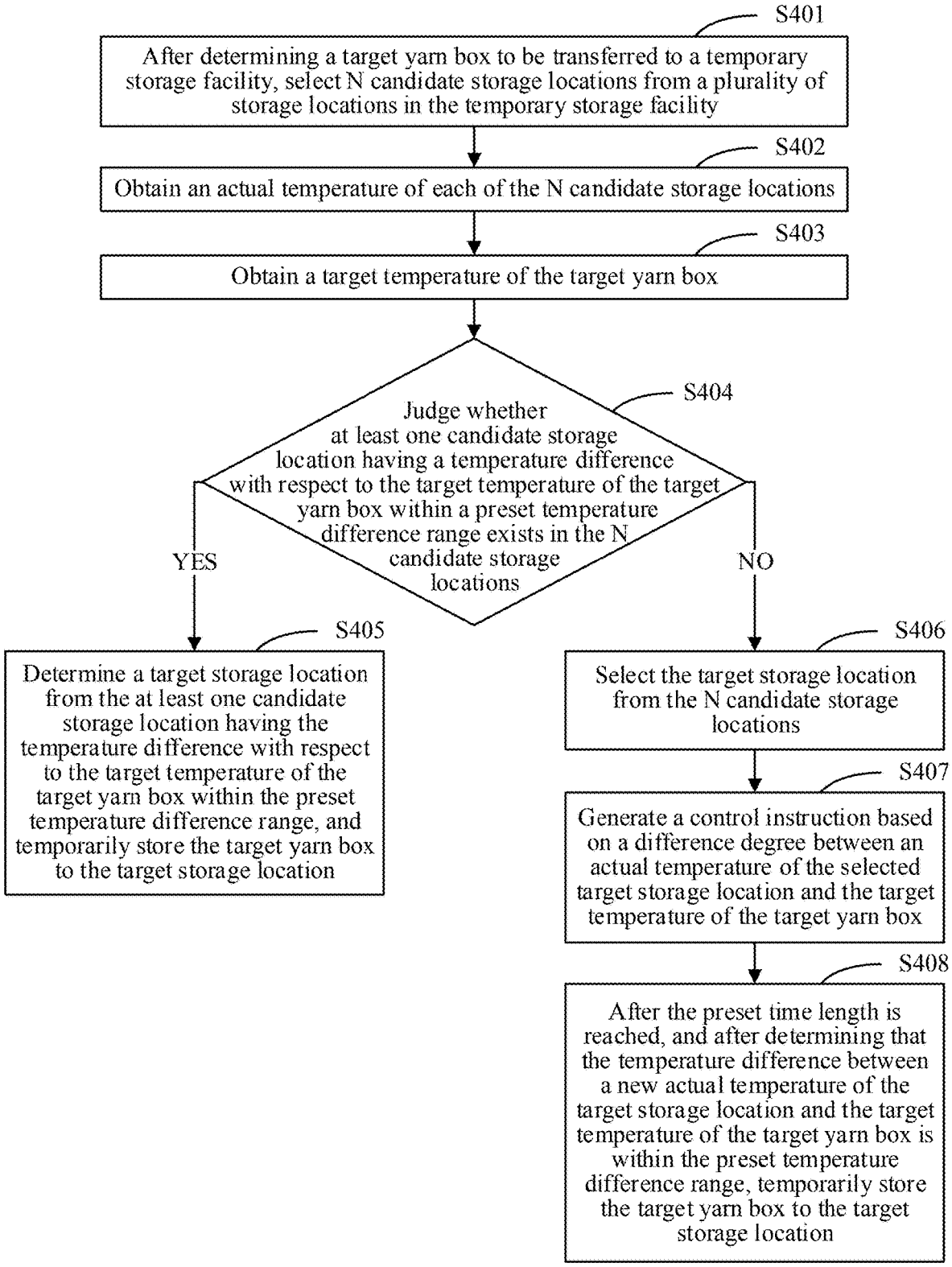
FIG. 4 is still another schematic flowchart illustrating a method of processing a yarn spindle according to an embodiment of the present disclosure.

FIG. 4 is still another schematic flowchart illustrating a method of processing a yarn spindle according to an embodiment of the present disclosure. The method is optionally applied to an electronic device, such as a personal computer, a server, and/or a server cluster. It can be understood that the contents related to the method shown in FIGS. 1 and 2 above can also be applied to the example and will not be described in detail herein.

Further, the method includes at least some of the following contents, as shown in FIG. 4, including the following steps.

Step S401: after determining a target yarn box to be transferred to a temporary storage facility, N candidate storage locations are selected from a plurality of storage locations in the temporary storage facility.

Here, the target yarn box contains a plurality of yarn spindles to be cooled; and N is a positive integer greater than or equal to 1.

Step S402: an actual temperature of each of the N candidate storage locations is obtained.

Step S403: a target temperature of the target yarn box is obtained.

Here, the execution sequence of Step S402 and Step S403 may also be such that Step S403 is executed first, and then Step S402 is executed. The present disclosure does not impose any limitations on the execution sequence of Step S402 and Step S403.

Further, in a specific example, the target temperature of the target yarn box can be obtained in the following mode to lay a foundation for quickly selecting a proper target storage location according to the target temperature of the target yarn box in the follow-up process, in which:

Mode I: obtaining the target temperature of the target yarn box (for example, the above Step S403) specifically includes:

Step S403-1-1: obtaining a temperature of environment where the target yarn box is located, where the temperature is collected by a sensor; and Step S403-1-2: obtaining the target temperature of the target yarn box based on the temperature of the environment where the target yarn box is located, for example, directly using the temperature of the environment where the target yarn box is located as the target temperature of the target yarn box.

Mode II: obtaining the target temperature of the target yarn box (for example, the above Step S403) specifically includes:

Step S403-2-1: obtaining doffing characteristic information of the target yarn box.

Here, the doffing characteristic information of the target yarn box is obtained based on at least doffing time of the yarn spindles in the target yarn box.

Here, for the description of the doffing time of the yarn spindle, reference can be made to the above example and the description thereof will not be repeated.

Step S403-2-2: estimating and obtaining the target temperature of the target yarn box based on the doffing characteristic information of the target yarn box.

For example, in an example, the temperature of each yarn spindle in the target yarn box may be obtained according to the doffing time of each yarn spindle included in the doffing characteristic information of the target yarn box and a mapping relationship between the doffing time of the yarn spindle and the temperature of the yarn spindle, and further the target temperature of the target yarn box may be obtained based on the temperature of each yarn spindle.

Step S404: whether at least one candidate storage location having a temperature difference with respect to the target temperature of the target yarn box within a preset temperature difference range exists in the N candidate storage locations is judged, and if yes, proceed to Step S405; otherwise, proceed to Step S406.

Step S405: after determining that at least one candidate storage location having a temperature difference with respect to the target temperature of the target yarn box within the preset temperature difference range exists in the N candidate storage locations, a target storage location is determined from the at least one candidate storage location having the temperature difference with respect to the target temperature of the target yarn box within the preset temperature difference range, and the target yarn box is temporarily stored to the target storage location.

Step S406: after determining that at least one candidate storage location having the temperature difference with respect to the target temperature of the target yarn box within the preset temperature difference range does not exist in the N candidate storage locations, the target storage location is selected from the N candidate storage locations, and proceed to Step S407.

Step S407: a control instruction is generated based on a difference degree between an actual temperature of the selected target storage location and the target temperature of the target yarn box, and proceed to Step S408.

Here, the control instruction is used for starting a preheating component to preheat the target storage location and re-obtaining the actual temperature of the target storage location after a preset time length is reached; or the control instruction is used for starting a heat energy recovery component to recover heat energy of the target storage location and re-obtaining the actual temperature of the target storage location after the preset time length is reached.

For example, in a case where it is determined that at least one candidate storage location having the temperature difference with respect to the target temperature of the target yarn box within the preset temperature difference range does not exist in the N candidate storage locations, any storage location is selected from the N candidate storage locations as the target storage location; in this regard, in an example, if the temperature difference between the actual temperature of the selected target storage location and the target temperature of the target yarn box is greater than or equal to a maximum value within the preset temperature difference range, a control instruction for starting the preheating component is generated to preheat the target storage location, so that a temperature difference between a new actual temperature of the target storage location and the target temperature of the target yarn box is within the preset temperature difference range.

Alternatively, in another example, if the temperature difference between the actual temperature of the selected target storage location and the target temperature of the target yarn box is less than a minimum value within the preset temperature difference range, a control instruction for starting the heat energy recovery component is generated to recover the heat energy and improve the energy efficiency, and meanwhile, the temperature is reduced as the heat energy is recovered, so that the temperature difference between a new actual temperature of the target storage location and the target temperature of the target yarn box can be within the preset temperature difference range.

Step S408: after the preset time length is reached, after determining that the temperature difference between a new actual temperature of the target storage location and the target temperature of the target yarn box is within the preset temperature difference range, the target yarn box is temporarily stored to the target storage location.

As such, the scheme of the present disclosure can obtain the storage location capable of appropriately cooling the target yarn box based on the target temperature of the target yarn box and the actual temperature of the candidate storage location, so as to provide more efficient cooling treatment to the target yarn box and avoid quick cooling to the yarn spindles in the target yarn box, thereby ensuring the quality of yarn spindles in the target yarn box. In addition, the scheme of the present disclosure can quickly select suitable storage location according to the actual conditions of the target yarn box, so that the use of the storage location is more reasonable and more automatic, thereby improving the treatment efficiency in the cooling link.

Furthermore, for a storage location with an overhigh temperature, the storage location can be subjected to effective heat energy recovery treatment so as to be used for other storage locations or process equipment (such as a process air conditioner) to be preheated, thereby greatly reducing the energy consumption cost of a workshop.

Figure 5:
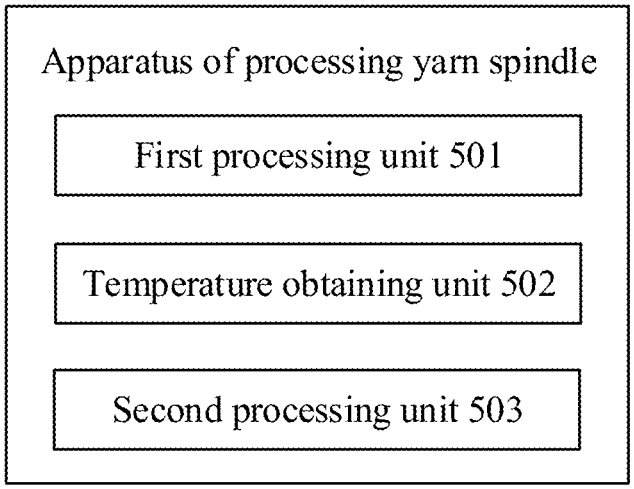
FIG. 5 is a structural diagram illustrating an apparatus of processing a yarn spindle according to an embodiment of the present disclosure.

The scheme of the present disclosure further provides an apparatus of processing a yarn spindle, as shown in FIG. 5, including:

a first processing unit 501, configured to, after determining a target yarn box to be transferred to a temporary storage facility, select N candidate storage locations from a plurality of storage locations in the temporary storage facility, where the target yarn box contains a plurality of yarn spindles to be cooled, and N is a positive integer greater than or equal to 1;

a temperature obtaining unit 502, configured to obtain an actual temperature of each of the N candidate storage locations; and a second processing unit 503, configured to select a target storage location from the N candidate storage locations based on the actual temperature of each candidate storage location, and temporarily store the target yarn box to the target storage location.

In a specific example according to the scheme of the present disclosure, the first processing unit is specifically configured to:

after determining the target yarn box to be transferred to the temporary storage facility, determine M storage locations in an idle state from the plurality of storage locations in the temporary storage facility; and in a case where the quantity M of the storage locations is greater than a first threshold value, select the N candidate storage locations from the M storage locations in the idle state, where M is a positive integer greater than or equal to N; or in a case where the quantity M of the storage locations is less than or equal to the first threshold value, designate the M storage locations in the idle state as the N candidate storage locations.

In a specific example according to the scheme of the present disclosure, the first processing unit is specifically configured to:

obtain doffing characteristic information of the target yarn box, where the doffing characteristic information of the target yarn box is obtained based on at least doffing time of the yarn spindles in the target box;

obtain the latest doffing time of the target yarn box based on the doffing characteristic information of the target yarn box; and select the N candidate storage locations from the M storage locations in the idle state based on idle time of each of the M storage locations in the idle state and the latest doffing time of the target yarn box.

In a specific example according to the scheme of the present disclosure, the first processing unit is specifically configured to:

obtain environmental characteristic information;

determine a time difference between the idle time of each of the M storage locations in the idle state and the latest doffing time of the target yarn box; and select the N candidate storage locations capable of performing cooling processing on the yarn spindles in the target yarn box under an environment represented by the environmental characteristic information based on the environmental characteristic information and the time difference corresponding to each of the M storage locations.

In a specific example according to the scheme of the present disclosure, the second processing unit is specifically configured to:

obtain a target temperature of the target yarn box; and after determining that at least one candidate storage location having a temperature difference with respect to the target temperature of the target yarn box within the preset temperature difference range exists in the N candidate storage locations, determine a target storage location from the at least one candidate storage location having the temperature difference with respect to the target temperature of the target yarn box within the preset temperature difference range, and temporarily store the target yarn box to the target storage location.

In a specific example according to the scheme of the present disclosure, the second processing unit is specifically configured to:

after determining that at least one candidate storage location having the temperature difference with respect to the target temperature of the target yarn box within the preset temperature difference range does not exist in the N candidate storage locations, select the target storage location from the N candidate storage locations; and generate a control instruction based on a difference degree between an actual temperature of the selected target storage location and the target temperature of the target yarn box, where the control instruction is used for starting a preheating component to preheat the target storage location and re-obtaining the actual temperature of the target storage location after a preset time length is reached; or the control instruction is used for starting a heat energy recovery component to recover heat energy of the target storage location and re-obtaining the actual temperature of the target storage location after the preset time length is reached.

In a specific example according to the scheme of the present disclosure, the second processing unit is specifically configured to:

obtain a temperature of environment where the target yarn box is located, where the temperature is collected by a sensor; and obtain the target temperature of the target yarn box based on the temperature of the environment where the target yarn box is located; or obtain doffing characteristic information of the target yarn box, where the doffing characteristic information of the target yarn box is at least obtained based on the doffing time of the yarn spindles in the target yarn box; and estimate and obtain the target temperature of the target yarn box based on the doffing characteristic information of the target yarn box.

For the description of specific functions and examples of each unit of the apparatus in the embodiment of the present disclosure, reference can be made to the related description of the corresponding steps in the foregoing method embodiments, and details thereof will not be repeated herein.

In the technical scheme of the present disclosure, the acquisition, storage and application of the user's personal information involved are all in compliance with the provisions of relevant laws and regulations, and do not violate public order and good customs.

Figure 6:
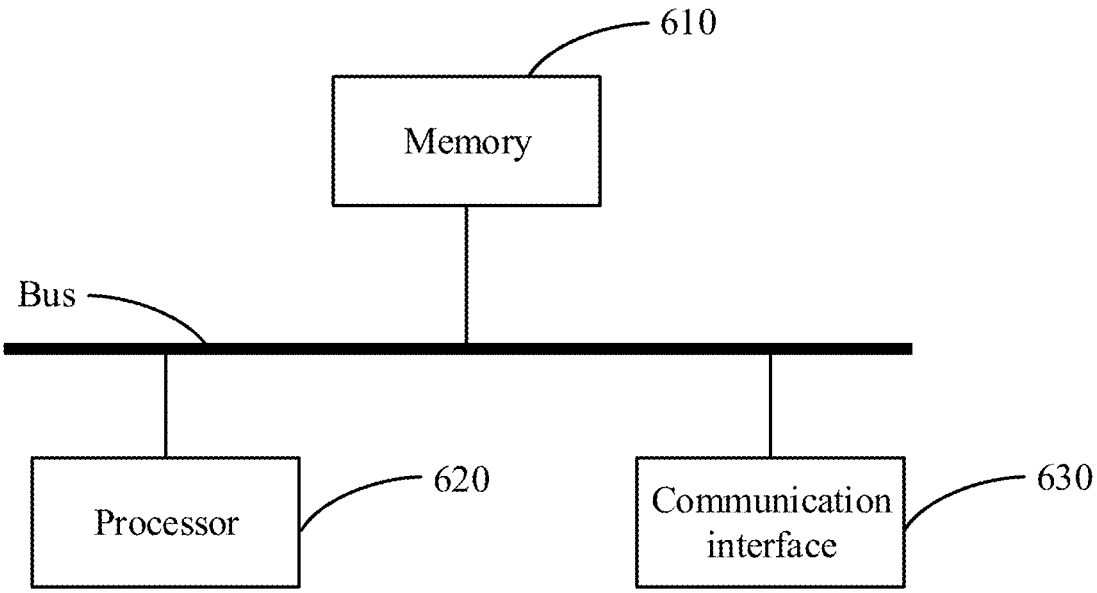
FIG. 6 is a block diagram illustrating an electronic device used to implement the method of processing the yarn spindle according to an embodiment of the present disclosure.

FIG. 6 is a structural block diagram of an electronic device according to an embodiment of the present disclosure. As shown in FIG. 6, the electronic device includes: a memory 610 and a processor 620, the memory 610 storing therein a computer program operable on the processor 620. The quantity of the memory 610 and the processor 620 may be one or more. The memory 610 may store one or more computer programs that, when executed by the electronic device, cause the electronic device to perform the methods according to the above-described method embodiments. The electronic device may further include: a communication interface 630 used for communicating with an external device to perform data interactive transmission.

If the memory 610, the processor 620, and the communication interface 630 are implemented independently, the memory 610, the processor 620, and the communication interface 630 may connect to and communicate with each other via a bus. The bus may be an Industry Standard Architecture (ISA) bus, a Peripheral Component Interconnect (PCI) bus, an Extended ISA (EISA) bus, or the like. The bus may be divided into an address bus, a data bus, a control bus, for example. For sake of illustration, the bus is represented by only one thick line in FIG. 6, but it does not mean only one bus or one type of bus is provided.

Optionally, in an implementation, if the memory 610, the processor 620, and the communication interface 630 are integrated on a chip, the memory 610, the processor 620, and the communication interface 630 may communicate with each other via an internal interface.

It should be understood that the processor may be a Central Processing Unit (CPU) or other general-purpose processor, a Digital Signal Processing (DSP), an Application Specific Integrated Circuit (ASIC), a Field Programmable Gate Array (FPGA) or other programmable logic device, discrete gate or transistor logic device or discrete hardware components, for example. The general-purpose processor may be a microprocessor or any conventional processor. It is noted that the processor may be a processor supporting an Advanced RISC Machine (ARM) architecture.

Further, optionally, the memory may include a read-only memory and a random-access memory, and may further include a non-volatile random-access memory. The memory may be a volatile memory or a nonvolatile memory, or may include both the volatile and the nonvolatile memory. The non-volatile memory may include a Read-Only Memory (ROM), a Programmable ROM (PROM), an Erasable PROM (EPROM), an Electrically EPROM (EEPROM), or a flash Memory. The volatile memory may include a Random-Access Memory (RAM), which acts as an external cache memory. By way of example and not limitation, many forms of RAM are available, such as Static RAM (SRAM), Dynamic Random-Access Memory (DRAM), Synchronous DRAM (SDRAM), Double Data Rate SDRAM (DDR SDRAM), Enhanced SDRAM (ESDRAM), Synchlink DRAM (SLDRAM), and Direct RAMBUS RAM (DR RAM).

The above embodiments may be implemented in whole or in part by software, hardware, firmware, or any combination thereof. When implemented in software, they may be implemented in whole or in part in the form of a computer program product. The computer program product includes one or more computer instruction. The computer instruction, when loaded and executed on a computer, can all or partially generate the flows or functions described in accordance with the embodiments of the present disclosure. The computer may be a general-purpose computer, a special-purpose computer, a network of computers, or other programmable devices. The computer instruction can be stored in a computer-readable storage medium or transmitted from one computer-readable storage medium to another computer-readable storage medium. For example, the computer instruction can be transmitted from one website, computer, server, or data center to another website, computer, server, or data center in a wire (e.g., coaxial cable, fiber optic or Digital Subscriber Line (DSL)) or wireless (e.g., infrared, Bluetooth of microwave) manner. The computer-readable storage medium can be any available medium that can be accessed by a computer or a data storage device, such as a server and a data center, that includes one or more available medium integrations. The available medium may be a magnetic medium (e.g., floppy Disk, hard Disk, magnetic tape), an optical medium (e.g., Digital Versatile Disk (DVD)), or a semiconductor medium (e.g., Solid State Disk (SSD)), etc. It should be noted that the computer-readable storage medium referred to in the present disclosure can be a non-volatile storage medium, i.e., a non-transitory storage medium.

It will be understood by those skilled in the art that all or part of the steps for performing the above embodiments may be implemented by hardware, or may be implemented by a program instructing relevant hardware, where the program may be stored in a computer-readable storage medium, and the storage medium may be a read-only memory, a magnetic disk or an optical disk.

In the description of the embodiments of the present disclosure, the description with reference to the terms such as "one embodiment", "some embodiments", "an example", "a specific example" or "some examples" means that a particular feature, structure, material, or characteristic described in connection with the embodiment or example is included in at least one embodiment or example of the present disclosure. Furthermore, the particular features, structures, materials, or characteristics described may be combined in any suitable manner in any one or more embodiments or examples. Moreover, various embodiments or examples and features in various embodiments or examples described in this specification can be combined and grouped by one skilled in the art if there is no mutual conflict.

In the description of the embodiments of the present disclosure, "/" indicates a meaning of "or", for example, A/B indicates a meaning of A or B, unless otherwise specified. The term "and/or" herein is merely an association relationship describing associated objects, and means that there may be three relationships, for example, A and/or B may mean: A alone, both A and B, and B alone.

In the description of the embodiments of the present disclosure, the terms "first" and "second" are used for descriptive purposes only and should not be construed as indicating or implying relative importance or implicitly indicating the number of technical features as indicated. Thus, a feature defined as "first" or "second" may explicitly or implicitly include one or more features. In the description of the embodiments of the present disclosure, "a plurality" means two or more unless otherwise specified.

The above description is intended only to illustrate embodiments of the present disclosure, and should not be taken as limiting thereof, and any modifications, equivalents and improvements made within the spirit and principle of the present disclosure will fall within the scope of the present disclosure.

What is claimed is:

1. A method of processing a yarn spindle, comprising:

after determining a target yarn box to be transferred to a temporary storage facility, selecting N candidate storage locations from a plurality of storage locations in the temporary storage facility, comprising:

after determining the target yarn box to be transferred to the temporary storage facility, determining M storage locations in an idle state from the plurality of storage locations in the temporary storage facility; and in a case of the quantity M of the storage locations is greater than a first threshold value, selecting the N candidate storage locations from the M storage locations in the idle state, comprising:

obtaining doffing characteristic information of the target yarn box; wherein the target yarn box contains a plurality of yarn spindles to be cooled, and the doffing characteristic information of the target yarn box is obtained based on at least doffing time of the yarn spindles in the target yarn box;

obtaining latest doffing time of the target yarn box based on the doffing characteristic information of the target yarn box; and selecting the N candidate storage locations from the M storage locations in the idle state based on idle time of each of the M storage locations in the idle state and the latest doffing time of the target yarn box; wherein N is a positive integer greater than or equal to 1, and M is a positive integer greater than or equal to N;

obtaining an actual temperature of each of the N candidate storage locations; and selecting a target storage location from the N candidate storage locations based on the actual temperature of each candidate storage location, and temporarily storing the target yarn box to the target storage location.

2. The method of claim 1, wherein after determining the target yarn box to be transferred to the temporary storage facility, selecting the N candidate storage locations from the plurality of storage locations in the temporary storage facility, comprises:

after determining the target yarn box to be transferred to the temporary storage facility, determining the M storage locations in the idle state from the plurality of storage locations in the temporary storage facility; and or in a case of the quantity M of the storage locations is less than or equal to the first threshold value, designating the M storage locations in the idle state as the N candidate storage locations.

3. The method of claim 1, wherein selecting the N candidate storage locations from the M storage locations in the idle state based on the idle time of each of the M storage locations in the idle state and the latest doffing time of the target yarn box comprises:

obtaining environmental characteristic information;

determining a time difference between the idle time of each of the M storage locations in the idle state and the latest doffing time of the target yarn box; and selecting the N candidate storage locations capable of performing cooling processing on the yarn spindles in the target yarn box under an environment represented by the environmental characteristic information based on the environmental characteristic information and the time difference corresponding to each of the M storage locations.

4. The method of claim 1, wherein selecting the target storage location from the N candidate storage locations based on the actual temperature of each candidate storage location, and temporarily storing the target yarn box to the target storage location comprises:

obtaining a target temperature of the target yarn box; and after determining that at least one candidate storage location having a temperature difference with respect to the target temperature of the target yarn box within a preset temperature difference range exists in the N candidate storage locations, determining a target storage location from the at least one candidate storage location having the temperature difference with respect to the target temperature of the target yarn box within the preset temperature difference range, and temporarily storing the target yarn box to the target storage location.

5. The method of claim 4, further comprising:

after determining that at least one candidate storage location having the temperature difference with respect to the target temperature of the target yarn box within the preset temperature difference range does not exist in the N candidate storage locations, selecting the target storage location from the N candidate storage locations; and generating a control instruction based on a difference degree between an actual temperature of the selected target storage location and the target temperature of the target yarn box, wherein the control instruction is used for starting a preheating component to preheat the target storage location and re-obtaining the actual temperature of the target storage location after a preset time length is reached; or the control instruction is used for starting a heat energy recovery component to recover heat energy of the target storage location and re-obtaining the actual temperature of the target storage location after the preset time length is reached.

6. The method of claim 4, wherein obtaining the target temperature of the target yarn box comprises:

obtaining a temperature of environment where the target yarn box is located, wherein the temperature is collected by a sensor, and obtaining the target temperature of the target yarn box based on the temperature of the environment where the target yarn box is located; or obtaining doffing characteristic information of the target yarn box, wherein the doffing characteristic information of the target yarn box is obtained based on at least doffing time of the yarn spindles in the target yarn box; and estimating and obtaining the target temperature of the target yarn box based on the doffing characteristic information of the target yarn box.

* * * * *